US005249375A

United States Patent [19]

Tabarly

[11] Patent Number: 5,249,375

[45] Date of Patent: Oct. 5, 1993

[54] BOOT FOR SAILING OR FOR WINTER SPORTS

[75] Inventor: Patrick Tabarly, Le Bono, France

[73] Assignee: Bottles le Chameau S.A., Pont d'Ouilly, France

[21] Appl. No.: 866,755

[22] Filed: Apr. 10, 1992

[30] Foreign Application Priority Data

Apr. 12, 1991 [FR] France ..... 91 04477

[51] Int. Cl.[5] ..... A43B 3/02

[52] U.S. Cl. ..... 36/1.5; 36/4

[58] Field of Search ..... 36/1.5, 2 R, 113, 8.3, 36/4; 2/DIG. 5

[56] References Cited

U.S. PATENT DOCUMENTS

| | | | |
|---|---|---|---|
| 495,450 | 4/1893 | Braunwarth | 36/4 |
| 800,761 | 10/1905 | Parkman | 36/1.5 |
| 1,590,047 | 6/1926 | Martin | 36/4 |
| 2,200,333 | 5/1940 | Herzog et al. | 36/4 |
| 2,306,306 | 12/1942 | Ferrettie | 36/4 |
| 2,673,405 | 3/1954 | Gossner | 36/4 |
| 2,824,390 | 2/1958 | Walker | 36/1.5 |
| 4,713,895 | 12/1987 | Valliéres | 36/1.5 |
| 4,941,213 | 7/1990 | Grilliot et al. | 36/1.5 |
| 5,067,260 | 11/1991 | Jenkins, Jr. | 36/7.1 R |

FOREIGN PATENT DOCUMENTS

| | | | |
|---|---|---|---|
| 8225106 | 12/1982 | Fed. Rep. of Germany . | |
| 8408650 | 10/1984 | Fed. Rep. of Germany . | |
| 22494 | of 1896 | United Kingdom | 36/2 R |
| 231690 | 4/1925 | United Kingdom | 36/4 |

*Primary Examiner*—Steven N. Meyers

*Attorney, Agent, or Firm*—Gottlieb, Rackman & Reisman

[57] ABSTRACT

A boot made of rubber or similar material, and including an outer cuff secured thereto around the ankle, the cuff rising up and being gathered together above the upper of the boot and being designed to be worn over a waterproof or oilskin trouser leg when the upper of the boot is slid inside said trouser leg, the outer cuff being made of a waterproof flexible material and including a drain outlet behind the ankle.

8 Claims, 1 Drawing Sheet

BOOT FOR SAILING OR FOR WINTER SPORTS

The invention relates to a boot that prevents water penetrating into the boot while it is being worn, such a boot being intended, in particular, for sailing or for certain winter sports.

BACKGROUND OF THE INVENTION

Sailors normally wear rubber boots beneath trousers made of waterproof material, generally cloth coated with water-proofing or "oilskins", thereby preventing water that is running down the trouser legs from penetrating into the boots. However, this technique is not satisfactory when working on deck while the sea is rough since waves breaking over the sailor's feet rise up the boot. Indeed, the curved front shape of a boot facilitates the passage of water between the boot upper and the trouser leg so that the water penetrates into the boot. In an attempt to keep their feet dry, sailors tend to turn their backs to the waves while they are maneuvering, but this is not always possible.

Tests have shown that changing the curved front shape of the boot to form a "breakwater" does not suffice, while sealing the oilskin trouser legs to the boots gives rise to an assembly that is rather rigid and does not allow the necessary freedom of movement.

A similar problem arises in some kinds of winter sports (e.g. snow scooter driving), where snow kicked up by the vehicle gets in between the trouser leg and the boot, and ends up by melting inside the boot.

SUMMARY OF THE INVENTION

The invention remedies the above-mentioned drawbacks by providing a boot made of rubber or similar material and including an outer cuff secured thereto around the ankle, the cuff rising up and being gathered together above the upper of the boot and being designed to be worn over a waterproof or oil-skin trouser leg when the upper of the boot is slid inside said trouser leg, the outer cuff being made of a waterproof flexible material and including a drain outlet behind the ankle.

As a result, when a wave strikes the feet of a sailor wearing such boots, water can only rise up the outside of the outer cuff, and even if it does penetrate between the cuff and the trouser leg, it then flows down the trouser leg between the trouser and the cuff and escapes from the cuff via the outlet at the back of the cuff.

After melting, snow escapes in similar manner.

Advantageously, the juncture or join line between the outer cuff and the boot upper slopes relative to the horizontal, with its lowest portion being at the back to facilitate draining out the water which flows downwards.

The top portion of the outer cuff must be large enough to receive both the boot upper and the oilskin trouser leg held down on the boot upper by a gathering device such as a lace or an elastic strip in a hem.

To be capable of being passed over the upper during manufacture of the boot, the bottom portion of the cuff must be larger than the calf of the boot, so to prevent material flapping around the ankle and the accompanying risks of catching and tearing, the cuff is held down against the curve of the ankle by one or more rows of elastic thread in the form of gathering and preferably in the form of smocking.

The material constituting the cuff must be waterproof, rot-proof, and resistant to tearing. Various sheet materials can be used, but polyamide cloth has been found to be particularly useful in particular because of its resistance to rubbing (as happens frequently against the shrouds when a sailor climbs the mast of a boat, or against the pedals and other parts of a vehicle being driven over snow).

It might be possible to use an elastic cloth for the cuff, thereby enabling the oilskin to be received in the top of the cuff and enabling the bottom of the cuff to follow the curve of the ankle, but unfortunately the kinds of elastic material presently available are too fragile and do not last long enough. That is why a non-elastic but stronger cloth is used as mentioned above, together with smocking at the bottom of the cuff.

The cuff may be secured to the upper in various different ways: gluing; welding; and sewing. However, the use of polyamide which is advantageous for its above-mentioned qualities has the drawback that rubber and polyamide are two materials that are very difficult to glue or to weld together. The use of natural rubber has great advantages given its qualities of withstanding water and seawater, its mechanical characteristics, and its properties of comfort and of hygiene for humans.

Thus, if necessary, advantage is taken of a normal step in the manufacture of a rubber boot to provide an extra thickness of reinforcing rubber on the portion covering the foot, and to apply a layer of rubber on a portion of the first rubber layer prior to vulcanization. Then, an elastic tape made of latex-impregnated cellulose material having the bottom portion of the cuff sewn thereto is placed at the desired location for installing the cuff and is covered by the top portion of the layer of rubber applied as a reinforcement. Since this layer is applied while the rubber is in the raw state, and since the inner layer of rubber is also in the raw state, the latex-impregnated cellulose tape becomes intimately bonded to the two layers of rubber by a reaction that takes place while the assembly is being vulcanized.

BRIEF DESCRIPTION OF THE DRAWING

An embodiment of the invention is described by way of example with reference to the accompanying drawing, in which.

DETAILED DESCRIPTION

Figure 1:
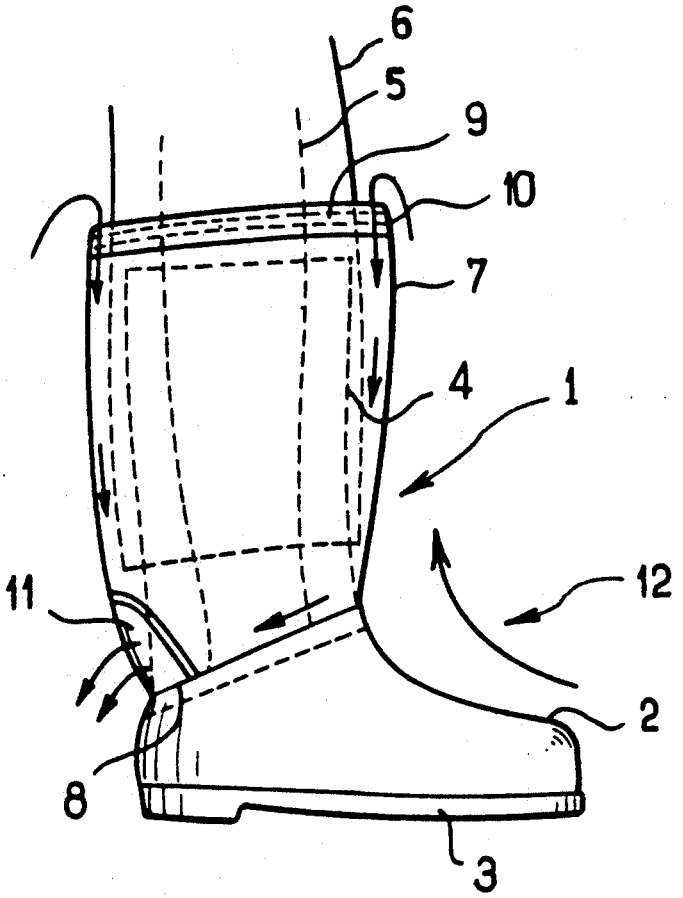
FIG. 1 is a side view showing the structure of a boot of the invention and showing how it operates.
Figure 2:
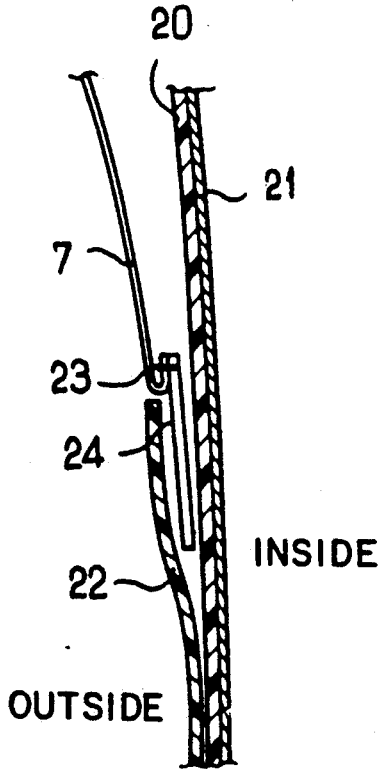
FIG. 2 fragmentary sectional detail is a view on a larger scale showing one way of mounting the cuff on the boot upper.

The following description relates specifically to a boot for sailing, but the invention applies equally well to any boot that is worn under circumstances where there is a danger of water getting up between the boot and a trouser leg (e.g. from water or snow spray).

A sailing boot 1 conventionally includes a vamp 2 mounted on a sole 3 and extended by an upper 4 that surrounds the leg 5 of the wearer. The wearer also wears waterproof trousers, generally "oilskins" and the corresponding trouser leg 6 is placed outside the boot upper 4.

In the invention, the boot 1 is fitted with a cuff 7 of waterproof material (cloth or sheet material) which is fixed to the boot at the ankle around a join line 8 whose structure is described in greater detail below. The cuff 7 rises above the upper 4 of the boot and is worn outside the trouser leg 6. To prevent the trouser leg escaping, an elastic strip 9 (or a lace) mounted in the top hem 10 of the cuff holds the cuff tight against the trouser leg around the sailor's leg.

At the back portion of the cuff 7, above the heel of the vamp, an outlet 11 is provided which may be in the form of a slot or which may be in the form of a permeable zone, of arbitrary shape, e.g. triangular with an upwardly directed point. The permeable zone may be constituted by a material that is itself permeable or by waterproof material that is perforated, e.g. having a net structure, a latticework structure, or some other structure.

When a wave 12 strikes the sailor's foot, the waterproof cuff 7 causes the upwardly travelling water to rise outside the trouser leg (i.e. it prevents the water from infiltrating into the space between the upper and the trouser leg from the bottom). The water that does penetrate between the cuff and the trouser leg does so from the top and then flows down towards the join line 8 and is removed via the outlet 11. This join line is advantageously disposed on a slope with its high end at the front so as to facilitate such water removal.

A method of mounting the cuff to the boot is now described which method is particularly advantageous when the cuff material is suitable neither for gluing nor for welding to the rubber that constitutes the boot, as applies when the cuff is made of polyamide, which material has other required characteristics of mechanical strength and proof against rotting.

The rubber boot is manufactured by applying a first layer of rubber 20 on a lining 21, which layer of rubber is applied to the outside surface of the boot-shaped lining. At positions that are subjected to the most severe stresses, it is common practice to apply a second layer of rubber 22 prior to vulcanizing both layers of rubber together.

For fixing the cuff 7, advantage is taken of this reinforcement by applying the second layer 22 over the entire vamp after the cuff 7 has been slid around the upper 4 and after the bottom portion of the cuff 7 has been positioned along the join line 8, a tape 24 of cellulose material having previously been sewn at 23 to said bottom portion. When the second layer 22 of rubber is applied around the desired join line 8, this already latex-impregnated cellulose tape 24 is secured between the two layers by vulcanization of the layers and by vulcanization of the latex impregnating the tape.

Such insertion may be performed after the two layers have been partially vulcanized so as to leave a slot between them into which the latex-impregnated tape can be slid prior to completing vulcanization of the rubbers.

In FIG. 1, to make the figure easier to read, the cuff 7 is not shown as fitting closely over the bulge of the ankle. Although that could be done, it is preferable for reasons of safety and appearance for it to fit closely. To this end, one or more elastic threads are provided at the bottom of the cuff to form gathering or smocking (not shown in the drawings), thereby tightening the cuff onto the upper, the trouser leg situated between them thus also being compressed to a small extent.

I claim:

1. A boot made of rubber or similar material for use by a person in sailing or for winter sports, said boot having a foot portion and an upper, with the latter extending upwardly from the ankle region of the boot and being adapted to receive the calf region of the wearer's leg and being further adapted to fit into a waterproof or oilskin trouser leg worn by the person, and said boot including a cuff of a waterproof flexible material positioned exteriorly of said upper and secured to said boot around said ankle region thereof, said cuff when at full length extending upwardly from said ankle region to a region just beyond the uppermost edge of said upper and being provided with means enabling said cuff to be gathered together above said upper of said boot and against said waterproof or oilskin trouser leg at the outside of the latter when said upper of said boot is slid inside said trouser leg, and said cuff at the join thereof with said boot including a drain outlet located rearwardly of said ankle region.

2. A boot according to claim 1, wherein the join between said cuff and said boot slopes relative to the horizontal, with the low portion of said join being at the back of said boot and corresponding to the bottom portion of said outlet.

3. A boot according to claim 1, wherein a cellulose tape is sewn to the bottom portion of said cuff, and said boot in the region of said join includes a first layer of rubber and a second layer of rubber forming an additional reinforcing thickness, said cellulose tape being inserted between and secured to said layers of rubber.

4. A boot according to claim 3, wherein said cellulose tape is impregnated with rubber latex and is secured to said layers of rubber by vulcanization.

5. A boot according to claim 1, wherein said outlet is a slot provided in said cuff.

6. A boot according to claim 1, wherein said outlet is a zone of said cuff constituted by permeable material.

7. A boot according to claim 1, wherein said outlet is a zone of said cuff constituted by waterproof material in which openings are formed.

8. A boot according to claim 1, wherein said boot is made of natural rubber and said cuff is made of polyamide.

* * * * *

UNITED STATES PATENT AND TRADEMARK OFFICE

CERTIFICATE OF CORRECTION

PATENT NO. : 5,249,375

DATED : October 5, 1993

INVENTOR(S) : Patrick Tabarly

It is certified that error appears in the above-identified patent and that said Letters Patent is hereby corrected as shown below:

On the title page, item [73] Assignee, for "Bottles Le Chameau S.A." read -- Bottes Le Chameau SA --.

Signed and Sealed this

Twenty-fourth Day of May, 1994

Bruce Lehman

*Attest:*

BRUCE LEHMAN

*Attesting Officer*

*Commissioner of Patents and Trademarks*